United States Patent [19]

Raffin

[11] 4,124,243

[45] Nov. 7, 1978

[54] HYDRAULIC ACTUATED GRAB BUCKET

[75] Inventor: Lucien A. Raffin, Lyons, France

[73] Assignee: International Harvester Company, Chicago, Ill.

[21] Appl. No.: 820,471

[22] Filed: Aug. 1, 1977

Related U.S. Application Data

[63] Continuation-in-part of Ser. No. 689,447, May 24, 1976, abandoned.

[51] Int. Cl.[2] ..... B66C 3/16; E02F 3/44

[52] U.S. Cl. ..... 294/70; 37/187; 294/88

[58] Field of Search ..... 294/70, 88, 106, 115; 37/183 R, 184–188, 117.5; 214/147 G, 656, 657

[56] References Cited

U.S. PATENT DOCUMENTS

| | | | |
|---|---|---|---|
| 2,890,806 | 6/1959 | Pilch | 294/70 X |
| 3,023,044 | 2/1962 | Drain et al. | 294/88 |
| 3,039,812 | 6/1962 | Nimeskern | 294/88 |
| 3,796,332 | 3/1974 | Kawamura | 294/88 X |
| 4,047,313 | 9/1977 | Bricon | 294/88 X |

FOREIGN PATENT DOCUMENTS

| | | | |
|---|---|---|---|
| 151,454 | 7/1962 | U.S.S.R. | 294/88 |

*Primary Examiner*—Johnny D. Cherry
*Attorney, Agent, or Firm*—Ronald C. Kamp; F. David AuBuchon

[57] ABSTRACT

This multi-purpose grab bucket of the type comprising a pair of hydraulically actuated symmetrical pivoting shells or scoops has a main central vertical hydraulic cylinder and piston actuator and lateral oblique hydraulic cylinder and piston actuators, and valves for selectively supplying hydraulic fluid under pressure to the central actuator or the lateral actuators for operating the assembly as a "digging" bucket or as a "rehandling" bucket, or in a third mode intermediate the "digging" and "rehandling" modes.

6 Claims, 5 Drawing Figures

HYDRAULIC ACTUATED GRAB BUCKET

This is a continuation-in-part application of Ser. No. 689,447 filed May 24, 1976 now abandoned.

BACKGROUND OF THE INVENTION

1. FIELD OF THE INVENTION

The present invention relates to a hydraulic grab bucket of the type comprising a pair of symmetrical conjugate pivoting shells or scoops the movements of which are controlled by means of hydraulic cylinder and piston actuator. This bucket is adapted to be mounted on handling and/or loading equipments, hoisting apparatus, cranes, excavators, etc.

2. DESCRIPTION OF THE PRIOR ART

Hitherto known grab buckets of this general type pertain to two main groups; on the one hand, the so-called "digging" buckets and on the other hand the so-called "rehandling" buckets, have well-defined functions embodied in structures differing considerably from one another.

A "digging" grab bucket, also referred to as an "earthmoving" grab bucket, is a bucket comprising two shells or scoops of which the jaws or cutting edges are adapted to penetrate relatively deeply into the soil when the control actuator or actuators is or are supplied with fluid under pressure. A bucket of this type is used chiefly for digging operations.

Hitherto known grab buckets belonging to this first group are constructed according to one of the following two forms of embodiment:

(a) In a first form of embodiment, the two shells are pivoted to the lower portion of a frame structure and their pivoting movements are controlled by means of oblique lateral cylinders connected on the one hand to the shells and on the other hand to said frame structure. Grab buckets of this type are disclosed for instance in the German Pat. No. 1,236,754 and in the British Pat. No. 712,759.

(b) In the second form of embodiment, the two shells are still pivoted to the lower portion of a frame structure but their pivoting movements are controlled by means of a central vertical cylinder connected to each shell through the medium of lateral connecting-rods. A typical grab bucket of this character is disclosed inter alia in the French Pat. No. 1,339,635.

A "rehandling" grab bucket (also referred to as a "retractable" bucket) comprises a pair of symmetrical shells of which the jaws or cutting edges are caused to move along a curved but relatively flat path, substantially parallel to the ground surface and therefore without penetrating appreciably into the soil. This type of bucket is currently used for picking up or shovelling loose material from the ground or a vehicle, platform and the like.

All "rehandling" buckets are constructed as follows: the shells are pivoted to the lower, movable end of a central vertical hydraulic cylinder, and each shell is connected through connecting-rods to the "fixed" member of the hydraulic cylinder. Grab buckets according to this structure are disclosed, for instance, in the French Pat. No. 2,049,191, German Pat. No. 1,189,248 and U.S. Pat. No. 1,535,878.

This brief survey of the present state of the art fairly proves that both groups of grab buckets lend themselves to extremely different forms of embodiment and that consequently manufacturers are compelled to produce two different ranges of buckets while the users are compelled to keep the two types of equipments, the substitution of one bucket type for another requiring in most instances the use of means such as disclosed in the above-mentioned German Pat. No. 1,189,248.

SUMMARY OF THE INVENTION

It is an object of the present invention to avoid the above-listed inconveniences by providing a dual-purpose grab bucket of the type broadly set forth in the foregoing, which is a capable of being operated both as a "digging" bucket and as a "rehandling" bucket, and therefore as a universal bucket, the change from one function to the other and vice-versa being particularly simple and obtained without resorting to any disassembling or addition of component elements.

It is also an object of this invention to provide a grab bucket which may be readily and selectively operated in any one of three modes; a "digging" bucket mode, a "rehandling" bucket mode or a combination or intermediate mode s, wherein the bucket is supplied with fluid pressure to simultaneously function in both "digging" and "rehandling" modes, but will react in an uncontrollable motion somewhere between the pure "digging" and pure "rehandling" modes, depending upon the relative effective piston areas and the resistances encountered.

To this end, the grab bucket according to this invention comprises, in combination, for controlling the movements of the shells or scoops thereof, a central vertical double-acting hydraulic cylinder-and-piston actuator (hereinafter referred to as "central actuator"), capable of displacing vertically the pivot means about which the shells are fulcrumed, lateral oblique double-acting hydraulic cylinder-and-piston actuators (hereinafter referred to as the "lateral actuators"), pivoted to the upper portion of each shell, respectively, and control means for selectively supplying hydraulic fluid under pressure to said central actuator and said lateral actuators, in order to operate the bucket either as a "digging" bucket or as a "rehandling" bucket.

Therefore, this grab bucket comprises a combination of "digging" bucket control means with "rehandling" bucket control means, whereby when the actuator or actuators corresponding to one function is or are supplied with hydraulic fluid, and the actuator or actuators corresponding to the other function is or are locked against movement, the conventional movements of a "digging" bucket or the conventional movements of a "rehandling" bucket are exactly obtained. Thus:

if the central actuator is locked the pivot pins of the shells are kept at a fixed height and feeding the lateral actuators will cause these shells to pivot about these pivot pins, as in the above-mentioned first form of embodiment of "digging" buckets;

if on the other hand the lateral actuators are locked, they act as connecting-rods and supplying fluid to the central actuator alone will shift the pivot pins of the shells vertically, thus imparting to these shells the conventional movement obtained in a "rehandling" bucket.

It may be emphasized that the control means contemplated herein permit of dispensing with any diassembling or conversion of the bucket for changing from one function to the other function, this change being obtained by simply acting on control members, such as distributors and valves, of a type currently used in the field of hydraulic control systems.

DESCRIPTION OF THE PREFERRED EMBODIMENT

Figure 1:
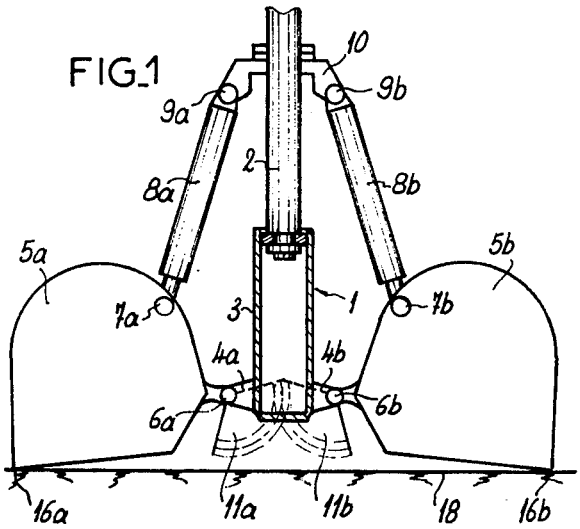
FIG. 1 is a front elevational view with parts shown in axial section, illustrating a typical form of embodiment of the grab bucket according to this invention, in its open position common to both functions.

As illustrated in FIG.1 the grab bucket according to this invention comprises a central vertical double-acting actuator 1 having its piston rod 2 suspended from a hoisting arm of any suitable type (not shown). Welded to the lower portion of the cylinder 3 of this actuator 1 are a pair of opposite lugs 4*a*, 4*b* to which the corresponding shells or scoops 5*a*, 5*b* of the bucket are fulcrumed, the pivot means therefore being designated diagrammatically by the reference symbols 6*a* and 6*b*, respectively.

The upper portion of each shell 5*a* and 5*b* is pivoted at 7*a*, 7*b*, respectively, to a lateral oblique double-acting actuator 8*a* or 8*b*. These lateral actuators 8*a* and 8*b* are pivoted in turn to a cross beam 10 locked against translation along the piston rod of actuator 2 but adapted to rotate freely in relation thereto. With this arrangement the bucket assembly can notably rotate about the rod 2.

Moreover, each shell 5*a* or 5*b* carries a toothed segment or quandrant 11*a* or 11*b*, respectively, centered to its fulcrum 6*a* or 6*b*, respectively, said toothed segments 11*a* and 11*b* being in mutual meshing engagement in order to ensure a precise synchronization or registration of the movements of said shells or scoops 5*a* and 5*b*.

Figure 4:
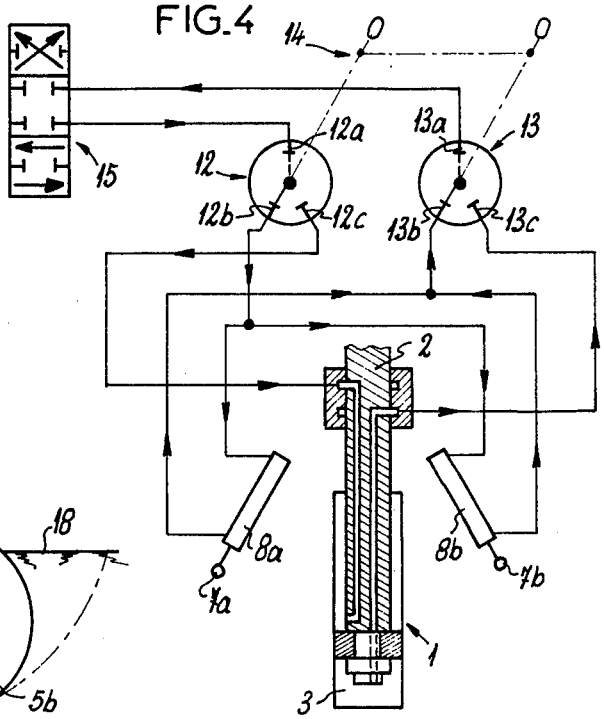
FIG. 4 is a diagram illustrating a typical embodiment of the hydraulic circuit for controlling the two bucket functions.

The means provided for controlling the actuators 2, 8*a* and 8*b* are illustrated in FIG. 4. They comprise notably a pair of three-way valves 12 and 13 adapted to be controlled manually and simultaneously through means shown diagrammatically at 14, and a distributor 15 of well-known type controlling the delivery of hydraulic fluid under pressure to first ports 12*a* and 13*a*, respectively, of valves 12 and 13.

Another port 12*b* of valve 12 is adapted to deliver fluid to the lateral actuators 8*a* and 8*b* so as to force their piston rods 2 outwards, and another port 13*b* of valve 13 is adapted to supply the same actuators 8*a* and 8*b* for producing the opposite or inward piston stroke, since these actuators are of the double-acting type as already mentioned hereinabove.

Similarly, the third port 12*c* of valve 12 is adapted to deliver fluid to the central actuator 1 via its piston rod 2 for driving the actuator cylinder 3 upwards, and the third port 13*c* of valve 13 permits the feeding of hydraulic fluid to the same actuator 1 for producing the reverse, i.e., outward, stroke of its piston rod 2.

However, this diagram should not be construed as limiting the present invention and is no part thereof, it is given only and primarily for explaining the mode of operation of the grab bucket of this invention. In fact, the hydraulic circuit associated with the bucket may be embodied in various ways by using different known means; thus, notably, according to another form of embodiment, a rotary distributor adapted to supply hydraulic fluid to the three actuators 1, 8*a* and 8*b* disposed around the piston rod 2 of actuator 1 on the cross beam 10, may be used.

Generally, the operation of the "digging" grab bucket is controlled by means of the lateral actuators 8*a* and 8*b*, and the operation thereof as a "rehandling" or "retractable" bucket is controlled by means of the central actuator 1. For a more detailed explanation of the mode of operation described hereinbelow, it will be assumed that the initial position will be the one illustrated in FIG. 1, this open bucket position being common to both functions.

In the "digging" bucket operation the hydraulic fluid delivered through the distributor 15 is directed to port 12*a* of valve 12 and then via port 12*b* to actuators 8*a* and 8*b* by properly setting this valve 12 by means of the manual control device 14 coupled to the control device of valve 13. This fluid will thus cause the piston rods of both actuators 8*a* and 8*b* to emerge from their cylinders while the fluid contained on the rod side of both cylinders flows through ports 13*b* and 13*a*, and through the distributor 15, back to a reservoir (not shown), as shown by the arrows in FIG. 4.

The ports 12*c* and 13*c* communicating with the central actuator 1 are closed, thus locking hydraulically this actuator which, in this first mode of operation, constitutes a "fixed" support for both shells 5*a* and 5*b*.

Figure 2:
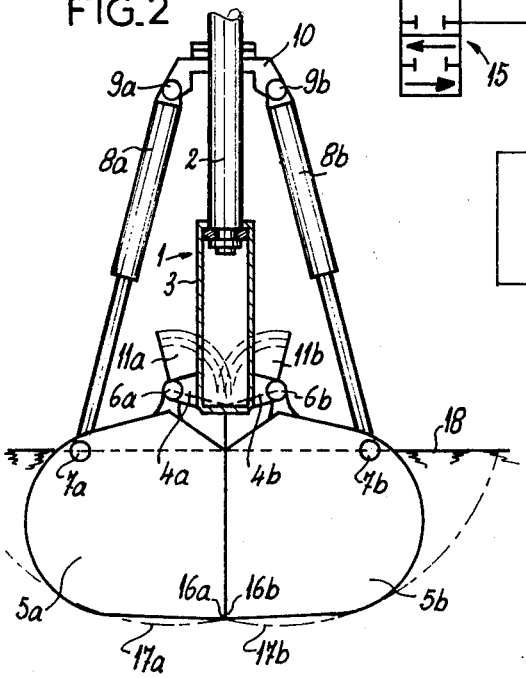
FIG. 2 is a similar view but showing the bucket in its closed position, during its operation as a "digging" bucket.

As illustrated in FIG. 2, the lateral actuators 8*a* and 8*b* cause the bucket shells 5*a* and 5*b* to rotate about the pivot means 6*a* and 6*b* thus held in a fixed position, until the shells are closed. The jaws or cutting edges 16*a* and 16*b* of these shells move along arcuate paths shown at 17*a* and 17*b*, respectively, so as to penetrate relatively deeply into the ground 18, assuming that initially (see FIG. 1) these edges 16*a* and 16*b* are exactly level with the ground surface. Therefore, the grab bucket is actually operated according to the principle of a "digging" bucket.

The shell opening movement and the resumption of the initial position of FIG. 1 are obtained by simply reversing the direction of flow of the hydraulic fluid by controlling the distributor 15, thus producing the reverse strokes of the lateral actuators 8*a* and 8*b*.

For operating the grab bucket as a "rehandling" bucket the operator actuates the manual control member 14 common to both valves 12 and 13 in the opposite direction so as to open ports 12*c*, 13*c* and close ports 12*b*, 13*b*. As a consequence, the lateral actuators 8*a* and 8*b* are locked and, in this second mode of operation, they act as fixed-length connecting-rods retaining the shells 5*a* and 5*b* through their corresponding interconnecting or pivot means 7*a* and 7*b*.

Under these conditions, actuating the distributor 15 will cause hydraulic fluid to be delivered through port 12*b* to the top portion of the cylinder of actuator 3 thus moving this cylinder upwards while the fluid contained in the lower portion thereof is returned through ports 13*c* and 13*a* of valve 13 to the reservoir (see arrows of FIG. 4).

Figure 3:
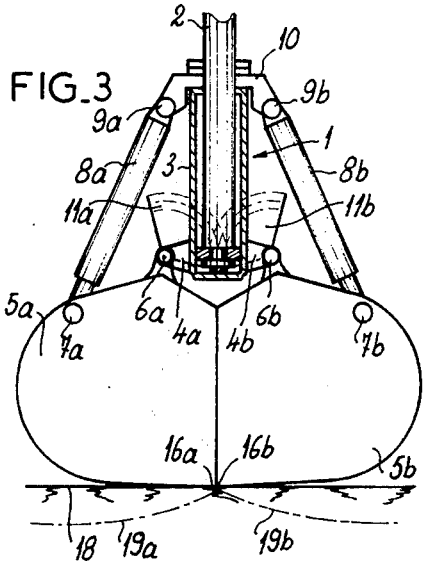
FIG. 3 is a similar view showing the same bucket in its closed position but during its operation as a "rehandling" bucket.

As illustrated in FIG. 3, the operation of the central actuator 1 moves the shells 5*a* and 5*b* toward each other so as to close the bucket with a compound movement resulting from:

the upward translation of their pivot pins 6a and 6b, and the rotation of pivot means 7a and 7b about the upper pivot means 9a and 9b on a radius corresponding to the minimum length of actuators 8a and 8b.

During this movement, the cutting edges or jaws 16a and 16b of shells 5a and 5b follow arcuate symmetrical paths 19a and 19b, respectively, which are substantially parallel to the ground level 18. Assuming that in the initial position (shown in FIG. 1) these edges 16a and 16b are exactly at ground level, their depth of penetration into the underlying soil or material is relatively small and therefore the grab bucket will actually operate according to the principle of the "rehandling" bucket.

The opposite opening movement is obtained by reversing the control of distributor 15 in order to force the cylinder 3 of the double-acting actuator 1 downwardly.

Figure 5:
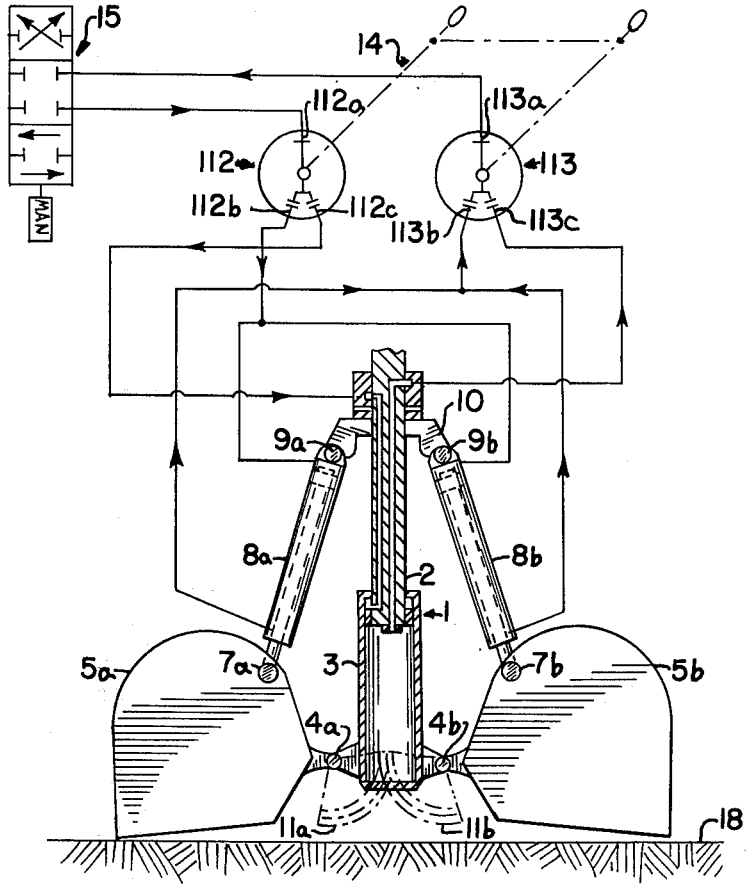
FIG. 5 is a diagram illustrating another embodiment of the invention.

The embodiment shown in FIG. 5, provides an operation intermediate the "digging" bucket function and the "rehandling" bucket function. In this embodiment, the valves 12 and 13 are replaced by valves 112 and 113, but otherwise the circuit and the bucket arrangement remain the same, with the same numerals in FIG. 5 designating the same or similar elements shown in, and described in connection with, FIGS. 1 through 4. In the position shown in FIG. 5, the port 112a of valve 112 is connected with both of the ports 112b and 112c. Similarly, the port 113a of valve 113 is connected with both of the ports 113b and 113c. In this position, if the valve 15 is shifted upward, hydraulic fluid pressure will be directed to the port 112a and through the valve 112 to the ports 112b and 112c, so that pressure will be directed to the head ends of the lateral actuators 8a and 8b as well as to the rod end of the central actuator 1. The hydraulic pressure will urge the lateral actuators 8a and 8b to extend, while simultaneously urging the central actuator 1 to collapse or retract. Either extension of the lateral actuators or retraction of the central actuator will cause bucket shells 5a and 5b to close. If there is no resistance encountered in closing the shells 5a and 5b, the bucket will rapidly close with the actuators at some intermediate point in their individual strokes. Should hydraulic pressure continue to be applied thereafter to the head ends of the lateral actuators and the rod end of the central actuators, the total area of the two lateral actuators, which exceeds the annular area of the rod end of the central actuator, will develop a greater force than that of the central actuator. The lateral actuators will overcome the force of the central actuator causing it to also extend and permitting the lateral actuators to extend full stroke. Should resistance to closing of the bucket be encountered, particularly at the outer edges, the central actuator will tend to go towards its fully retracted position more quickly than the lateral actuators will in their movement toward a fully extended position. Once the bucket is closed, the central actuator will be overcome by the greater total force of the lateral actuators and the closed bucket will simply move vertically downward, assuming no obstruction to such movement, as the lateral actuators extend. The advantage of such an arrangement is in loading or handling of relatively light, loose materials which are deposited upon relatively hard and/or heavy materials. The combined mode will permit a limited digging action in the upper material while discouraging such action in the lower material.

Movement of the handle 14 clockwise from the position shown in FIG. 5 will result in ports 112c and 113c being blocked and ports 112b and 113b being connected with ports 112a and 113a respectively. The central actuator 1 will therefore be hydraulically locked, while the lateral actuators 8a and 8b will extend if valve 15 is shifted upward or contract if valve 15 is shifted downward.

Movement of the handle 14 counterclockwise will result in ports 112b and 113b being blocked and ports 112c and 113c being connected with ports 112a and 113a respectively. Under this condition, the lateral actuators 8a and 8b will be hydraulically locked, while the central actuator 1 will be capable of movement. If the valve 15 is shifted upward, the central actuator 1 will be contracted causing the bucket to close and of the valve 15 is shifted downward, the central actuator 1 will extend causing the bucket to open.

Although the invention is intended for grab buckets of the type currently used for earthmoving works, it is applicable more generally to grab buckets of all types and sizes designed for handling miscellaneous materials and products, such as coal, earth, beets, wood, etc. Therefore, the term "shell" or "scoop" as used herein should be understood as designating only the two movable halves of the bucket, without implying any specific or limiting shape or size thereof, these shells or scoops having for instance the form of buckets, jaws, forks, etc.

It will readily occur to those skilled in the art that this invention should not be considered as being strictly limited by the single form of embodiment of dual-purpose grab bucket described hereinabove and illustrated in the accompanying drawing, since many modifications and variations may be brought thereto without departing from the basic principle of the invention, for example by substituting equivalent technical means for those described and illustrated.

What is claimed is:

1. A dual purpose grab bucket comprising:

a central actuator including a rod and a cylinder, one of which is fixed;

a plurality of shells pivotally connected to the other one of said rod and cylinder;

a plurality of lateral actuators, each having one end pivotally connected to one of the shells and the other end connected to the fixed one of said rod and cylinder; and valve means for selectively directing hydraulic fluid pressure to one of said central actuator and said plurality of lateral actuators while simultaneously hydraulically locking the other of said central and lateral actuators.

2. A dual purpose grab bucket according to claim 1, wherein said shells including intermeshing gear segments to synchronize the movement of the shells.

3. A dual purpose grab bucket comprising:

a central actuator including a rod and a cylinder;

a pair of shells pivotally connected to one of said rod and cylinder;

a pair of lateral actuators, each having one end pivotally connected to one of the shells and the other end connected to the other of said rod and cylinder;

valve means for selectively directing fluid pressure to one of said central actuator and said pair of lateral actuators while hydraulically locking the other of said actuators.

4. A multi-purpose grab bucket comprising:

a central actuator including a rod and a cylinder;

a pair of shells pivotally connected to one of said rod and cylinder;

a pair of lateral actuators, each having one end pivotally connected of one of the shells and the other end connected to the other of said rod and cylinder;

valve means for selectively directing fluid pressure to said actuators to close said shells in any one of three modes;

mode one in which the central actuator is retracted while the lateral actuators are hydraulically locked;

mode two in which the lateral actuators are extended while the central actuator is hydraulically locked; and mode three in which the lateral actuators receive fluid pressure to cause extension thereof and the central actuator receives fluid pressure to cause retraction thereof.

5. A multi-purpose grab bucket comprising:

a central actuator including a rod and a cylinder;

a plurality of shells pivotally connected to one of said rod and cylinder;

a plurality of lateral actuators, each having one end pivotally connected to one of the shells and the other end connected to the other of said rod and cylinder;

a three position valve means for selectively directing hydraulic fluid pressure to said actuators to close said shells in one of three modes;

mode one in which the valve means directs hydraulic pressure to retract said central actuator while simultaneously hydraulically locking the lateral actuators;

mode two in which the valve means directs hydraulic fluid pressure to extend the lateral actuators while simultaneously hydraulically locking the central actuator; and mode three in which the valve means simultaneously directs hydraulic fluid pressure to extend the lateral actuators and retract the central actuator.

6. A multi-purpose grab bucket according to claim 5, and further comprising:

a distributor valve upstream of and in series with said valve means and having a central neutral position which hydraulically locks all of said actuators and selectively moveable from said central neutral position to direct hydraulic fluid pressure to said valve means to effect opening and closing said shells as determined by the position of valve means.

* * * * *